United States Patent [19]

Sapre

[11] Patent Number: 4,985,133

[45] Date of Patent: Jan. 15, 1991

[54] REDUCING $NO_x$ EMISSIONS FROM FCC REGENERATORS BY SEGREGATED CRACKING OF FEED

[75] Inventor: Ajit V. Sapre, W. Berlin, N.J.

[73] Assignee: Mobil Oil Corporation, Fairfax, Va.

[21] Appl. No.: 479,308

[22] Filed: Feb. 12, 1990

[51] Int. Cl.[5] ..... C10G 71/00

[52] U.S. Cl. ..... 208/78; 208/80; 208/113; 208/85; 208/153; 266/254; 266/127; 502/12; 502/20; 502/514

[58] Field of Search ..... 208/80, 78, 113, 85, 208/153

[56] References Cited

U.S. PATENT DOCUMENTS

| | | | |
|---|---|---|---|
| 3,224,958 | 12/1965 | Schlinger | 208/80 |
| 3,617,494 | 11/1971 | Montgomery | 208/80 |
| 3,941,680 | 3/1976 | Bryson et al. | 208/80 |
| 4,073,718 | 2/1978 | Hamner | 208/80 |
| 4,218,306 | 8/1980 | Gross et al. | 208/120 |
| 4,869,807 | 9/1989 | Krishna | 208/80 |

*Primary Examiner*—Helane E. Myers

*Attorney, Agent, or Firm*—Alexander J. McKillop; Charles J. Speciale; Richard D. Stone

[57] ABSTRACT

A fluidized catalytic cracking process using a riser reactor to crack a mixture of high and low nitrogen content fresh feeds is operated to reduce $NO_x$ emissions in the regenerator flue gas. Segregation of the feed into high and low nitrogen content streams, and addition of the high nitrogen content feed to the base of the riser, followed by separate addition of the low nitrogen content feed higher up in the riser, reduces $NO_x$ emissions and reduces production of low value products from the FCC unit.

15 Claims, No Drawings

REDUCING $NO_x$ EMISSIONS FROM FCC REGENERATORS BY SEGREGATED CRACKING OF FEED

BACKGROUND OF THE INVENTION

1. Field of the Invention

The invention relates to catalytic reduction of oxides of nitrogen, $NO_x$, produced in the regenerators associated with catalytic cracking unit regenerators.

2. Description of Related Art

The presence of $NO_x$, or oxides of nitrogen, in flue gas streams, is a pervasive problem. Several powerful ways have been developed to deal with the problem. The approaches fall into roughly three categories, process approaches which inherently reduce the amount of $NO_x$ formed in a regenerator, catalytic approaches using a catalyst or additive which is compatible with the FCC reactor, and stack gas cleanup methods which are isolated from the FCC process. The FCC process will be briefly reviewed, followed by a review of the state of the art in reducing $NO_x$ emissions.

FCC PROCESS

Catalytic cracking of hydrocarbons is carried out in the absence of externally supplied H2, in contrast to hydrocracking, in which H2 is added during the cracking step. An inventory of particulate catalyst is continuously cycled between a cracking reactor and a catalyst regenerator. In the fluidized catalytic cracking (FCC) process, hydrocarbon feed contacts catalyst in a reactor at 425° C.-600° C., usually 460° C.-560° C. The hydrocarbons crack, and deposit carbonaceous hydrocarbons or coke on the catalyst. The cracked products are separated from the coked catalyst. The coked catalyst is stripped of volatiles, usually with steam, and is then regenerated. In the catalyst regenerator, the coke is burned from the catalyst with oxygen containing gas, usually air. Coke burns off, restoring catalyst activity and simultaneously heating the catalyst to, e.g., 500° C.-900° C., usually 600° C.-750° C. Flue gas formed by burning coke in the regenerator may be treated for removal of particulates and for conversion of carbon monoxide, after which the flue gas is normally discharged into the atmosphere.

Most FCC units now use zeolite-containing catalyst having high activity and selectivity. These catalysts work best when the amount of coke on the catalyst after regeneration is relatively low. It is desirable to regenerate zeolite catalysts to as low a residual carbon level as is possible. It is also desirable to burn CO completely within the catalyst regenerator system to conserve heat and to minimize air pollution. Heat conservation is especially important when the concentration of coke on the spent catalyst is relatively low as a result of high catalyst selectivity. Among the ways suggested to decrease the amount of carbon on regenerated catalyst and to burn CO in the regenerator is to add a CO combustion promoter metal to the catalyst or to the regenerator. Metals have been added as an integral component of the cracking catalyst and as a component of a discrete particulate additive, in which the active metal is associated with a support other than the catalyst. U.S. Pat. No. 2,647,860 proposed adding 0.1 to 1 weight percent chromic oxide to a cracking catalyst to promote combustion of CO. U.S. Pat. No. 3,808,121, incorporated herein by reference, introduced relatively large-sized particles containing CO combustion-promoting metal into a cracking catalyst regenerator. The circulating particulate solids inventory, of small-sized catalyst particles, cycled between the cracking reactor and the catalyst regenerator, while the combustion-promoting particles remain in the regenerator. Oxidation-promoting metals such as cobalt, copper, nickel, manganese, copper-chromite, etc., impregnated on an inorganic oxide such as alumina, are disclosed.

U.S. Pat. Nos. 4,072,600 and 4,093,535 teach use of combustion-promoting metals such as Pt, Pd, Ir, Rh, Os, Ru and Re in cracking catalysts in concentrations of 0.01 to 50 ppm, based on total catalyst inventory. This approach is so successful that most FCC units use CO combustion promoters. This reduces CO emissions, but usually increases nitrogen oxides ($NO_x$) in the regenerator flue gas. It is difficult in a catalyst regenerator to completely burn coke and CO in the regenerator without increasing the $NO_x$ content of the regenerator flue gas.

PROCESS APPROACHES TO $NO_x$ CONTROL

Process modifications are suggested in U.S. Pat. No. 4,413,573 and U.S. Pat. No. 4,325,833 directed to two- and three-stage FCC regenerators, which reduce $NO_x$ emissions.

U.S. Pat. No. 4,313,848 teaches countercurrent regeneration of spent FCC catalyst, without backmixing, to minimize $NO_x$ emissions.

U.S. Pat. No. 4,309,309 teaches the addition of a vaporizable fuel to the upper portion of a FCC regenerator to minimize $NO_x$ emissions. Oxides of nitrogen formed in the lower portion of the regenerator are reduced in the reducing atmosphere generated by burning fuel in the upper portion of the regenerator.

The approach taken in U.S. Pat. No. 4,542,114 is to minimize the volume of flue gas by using oxygen rather than air in the FCC regenerator, with consequent reduction in the amount of flue gas produced.

In Green et al, U.S. Pat. No. 4,828,680, which is incorporated herein by reference, the level of $NO_x$ emissions from a fluidized catalytic cracking (FCC) unit was reduced by incorporating carbonaceous particles such as sponge, coke or coal into the circulating inventory of cracking catalyst. The carbonaceous particle performed several functions, selectively absorbing metal contaminants in the feed and also reducing $NO_x$ emissions in certain instances.

This approach is well suited to FCC units, where large volumes of coal or coke containing particles can be easily handled. Some modification of the FCC unit may be necessary, and the reduction in $NO_x$ emissions may not be as great as desired.

Another process approach is to create a relatively reducing atmosphere in some portion of the regenerator by segregating the CO combustion promoter. Reduction of $NO_x$ emissions in FCC regenerators was achieved in U.S. Pat. Nos. 4,812,430 and 4,812,431 by using a conventional CO combustion promoter (Pt) on an unconventional support which permitted the support to segregate in the regenerator. Use of large, hollow, floating spheres gave a sharp segregation of CO combustion promoter in the regenerator. Disposing the CO combustion promoter on fines, and allowing these fines to segregate near the top of a dense bed, or to be selectively recycled into the dilute phase above a dense bed, was another way to segregate the CO combustion promoter.

CATALYTIC APPROACHES TO $NO_x$ CONTROL

Recent catalyst patents include U.S. Pat. No. 4,300,997 and its division U.S. Pat. No. 4,350,615, both directed to the use of Pd-Ru CO-combustion promoter. The bi-metallic CO combustion promoter is reported to do an adequate job of converting CO to CO2, while minimizing the formation of $NO_x$.

Another catalyst development is disclosed in U.S. Pat. No. 4,199,435 which suggests steam treating conventional metallic CO combustion promoter to decrease $NO_x$ formation without impairing too much the CO combustion activity of the promoter.

U.S. Pat. No. 4,235,704 suggests too much CO combustion promoter causes $NO_x$ formation, and calls for monitoring the $NO_x$ content of the flue gases, and adjusting the concentration of CO combustion promoter in the regenerator based on the amount of $NO_x$ in the flue gas. As an alternative to adding less CO combustion promoter the patentee suggests deactivating it in place, by adding something to deactivate the Pt, such as lead, antimony, arsenic, tin or bismuth.

All the catalyst and process patents discussed above in the sections devoted to process and catalytic routes to reduction of $NO_x$ emissions are incorporated herein by reference.

STACK GAS TREATMENT

It is also known to react $NO_x$ in flue gas with NH3. NH3 is a very selective reducing agent, which does not react rapidly with excess oxygen which may be present in the flue gas.

Two types of $NH_3$ process have evolved, thermal and catalytic.

Thermal processes, such as the Exxon Thermal $DeNO_x$ process, generally operate as homogeneous gas-phase processes at very high temperatures, typically around 1550°-1900° F. More details of such a process are disclosed by Lyon, R. K., Int. J. Chem. Kinet., 3, 315, 1976, which is incorporated herein by reference.

The catalytic systems which have been developed operate at much lower temperatures, typically at 300°-850° F. These temperatures are typical of flue gas streams. Unfortunately, the catalysts used in these processes are readily fouled, or the process lines plugged, by catalyst fines which are an integral part of FCC regenerator flue gas. U.S. Pat. No. 4,521,389 and U.S. Pat. No. 4,434,147 disclose adding NH3 to $NO_x$ containing flue gas to catalytically reduce the $NO_x$ to nitrogen.

None of the approaches described above provides the perfect solution. Process approaches, such as multistage or countercurrent regenerators, reduce $NO_x$ emissions but require extensive rebuilding of the FCC regenerator.

Various catalytic approaches, e.g., addition of lead or antimony, as taught in U.S. Pat. No. 4,235,704, to degrade the efficiency of the Pt function may help some but still may fail to meet the ever more stringent $NO_x$ emissions limits set by local governing bodies. It is also important, in many FCC units, to maintain the effectiveness of the CO combustion promoter, in order to meet CO emissions limits.

Stack gas cleanup methods are powerful, but the capital and operating costs are high.

It seemed there was no easy way to reduce $NO_x$ emissions.

I decided to examine closely the way the cracking process operated, to see if there was a way to achieve the goal of reduced $NO_x$ emissions without spending large amounts for unit modifications. Although the $NO_x$ emissions are created in, and are a problem in, the FCC regenerator, I looked elsewhere for a solution to the problem. I discovered a way to modify the cracking reaction which reduced the $NO_x$ emissions in the regenerator. My modifications to the cracking reactor section involve little or no capital expense, and incur little or no operating penalty, while providing significant reductions in $NO_x$ emissions.

BRIEF SUMMARY OF THE INVENTION

Accordingly the present invention provides in a fluidized catalytic cracking process wherein a fresh feed mixture of high and low nitrogen containing hydrocarbon feeds contact a source of hot regenerated catalyst in the base of a riser cracking reactor means to produce catalytically cracked products and spent catalyst containing coke contaminated with nitrogen compounds, wherein the spent catalyst is stripped in a catalyst stripping means to produce stripped catalyst which is regenerated in a catalyst regeneration means to produce a regenerated catalyst which is recycled to the cracking reactor means, and wherein a flue gas comprising nitrogen oxides ($NO_x$) is withdrawn from the regenerator, the improvement comprising segregating the fresh feed mixture into at least two different fresh feed fractions having different nitrogen contents, said segregated feed fractions comprising a low nitrogen content fresh feed and a high nitrogen content fresh feed having at least a 50% greater concentration of nitrogen than the low nitrogen content fresh feed, adding said high nitrogen content fresh feed via a feed addition means at an elevation in the base of the riser reactor, and separately adding said low nitrogen content fresh feed to the riser reactor at a higher elevation in said riser reactor and downstream of the point of addition of said high nitrogen content fresh feed, whereby the $NO_x$ content of the flue gas is reduced relative to operation with a feed comprising a mixture of said high and said low nitrogen containing feedstocks.

In a more limited embodiment, the present invention provides in a fluidized catalytic cracking process wherein a fresh feed mixture of high nitrogen fresh feed containing more than 500 ppm basic nitrogen and a low nitrogen content fresh feed containing less than 500 ppm basic nitrogen and mixed and charged to the base of a riser cracking reactor means to contact a source of hot regenerated catalyst and produce catalytically cracked products and spent catalyst containing coke contaminated with nitrogen compounds, wherein the spent catalyst is stripped in a catalyst stripping means to produce stripped catalyst which is regenerated in a catalyst regeneration means to produce a regenerated catalyst which is recycled to the cracking reactor means, and wherein a flue gas comprising nitrogen oxides ($NO_x$) is withdrawn from the regenerator, the improvement comprising segregating the fresh feed mixture into at least two segregated fresh feed fractions, having boiling ranges which overlap through at least 50% of the boiling range of each feed, and different nitrogen contents, said segregated feed fractions comprising a low nitrogen content fresh feed containing less than 400 ppm basic nitrogen and a high nitrogen content fresh feed having at least 600 ppm basic nitrogen, and adding said high nitrogen content fresh feed via a feed addition means at an elevation in the base of the riser reactor, and separately adding said low nitrogen content fresh feed, in an amount equal to 10 to 50 wt % of said high nitrogen content fresh feed, to said riser reactor at a higher elevation in said riser reactor and downstream of the point of addition of said high nitrogen content fresh feed, whereby the $NO_x$ content of the flue gas is reduced relative to operation with a feed comprising a mixture of said high and said low nitrogen containing feedstocks.

DETAILED DESCRIPTION

The present invention is an improvement for use in any catalytic cracking unit which uses a riser cracking reactor. Although a change in reactor operation is what makes the present invention work, the entire cracking process should be considered in order to better describe how the invention works. Accordingly, the essential elements of the FCC process, ranging from the feed, to the reactor and the catalysts used, will be briefly reviewed. After this review, the conventional and improved method of operating the FCC riser reactor will be reviewed.

FCC FEEDS

The process of the present invention requires that the feed to the FCC unit be segregated into two feeds, a low nitrogen feed and a high nitrogen feed. Usually the two feeds will have similar boiling ranges, but in some circumstances one feed may have a different boiling range. It will be possible, with some crudes, to obtain a relatively heavier and relatively lighter fraction with sufficiently different nitrogen contents to make the practice of the present invention worthwhile.

Segregated processing of different crudes through the refinery crude distillation column, and segregated storage of at least one resulting high or low nitrogen content heavy feed will be the preferred mode of operation in most refineries. By this is meant that the crude distillation column will be fed a high nitrogen feed for a week or two, and the resulting nitrogenous gas oil or vacuum gas oil will be stored as the high nitrogen feed. When the crude distillation column processes a low nitrogen feed, the low nitrogen gas oil or vacuum gas oil can be fed as one of the required feeds directly from the crude distillation column to the FCC, while the second feed is withdrawn from storage. The processing sequence can be reversed whenever feed to the crude distillation column changes from low to high nitrogen, or vice versa.

Any conventional FCC feeds can be used as either charge stock. The process of the present invention is useful for processing a mix of low and high nitrogen containing charge stocks. High nitrogen containing charge stocks are those containing more than 500 ppm total nitrogen compounds, and useful for those stocks containing very high levels of nitrogen compounds, e.g., more than 1000 wt ppm total nitrogen compounds.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids. The present invention is most useful with feeds having an initial boiling point above about 650° F.

FCC CATALYST

Any commercially available FCC catalyst may be used. The catalyst can be 100% amorphous, but preferably includes some zeolite in a porous refractory matrix such as silica-alumina, clay, or the like. The zeolite is usually 5–40 wt % of the catalyst, with the rest being matrix. Conventional zeolites such as X and Y zeolites, dealuminized Y (DEAL Y), ultrastable Y (USY) and ultrahydrophobic Y (UHP Y) zeolites may be used. The zeolites may be stabilized with Rare Earths, e.g., 0.1 to 10 wt % RE.

Relatively high silica zeolite containing catalysts are preferred for use in the present invention. They withstand the high temperatures usually associated with complete combustion of CO to CO2 within the FCC regenerator. Catalysts containing 10–40% USY or rare earth USY (REUSY) are especially preferred.

The catalyst inventory may also contain one or more additives, either present as separate additive particles, or mixed in with each particle of the cracking catalyst. Additives can be added to enhance octane (medium pore size zeolites, sometimes referred to as shape selective zeolites, i.e., those having a Constraint Index of 1–12, and typified by ZSM-5, and other materials having a similar crystal structure).

The FCC catalyst composition, per se, forms no part of the present invention.

CO COMBUSTION PROMOTER

CO combustion additives are available from most FCC catalyst vendors.

Use of a CO combustion promoter in the regenerator or combustion zone is not essential for the practice of the present invention, however, it is preferred. These materials are well-known.

U.S. Pat. No. 4,072,600 and U.S. Pat. No. 4,235,754, which are incorporated by reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit.

SOx ADDITIVES

Additives may be used to adsorb SOx. These are believed to be primarily various forms of alumina, containing minor amounts of Pt, on the order of 0.1 to 2 ppm Pt.

Good additives for removal of SOx are available from several catalyst suppliers, such as Davison's "R" or Katalistiks International, Inc.'s "DESOX."

The process of the present invention is believed to work fairly well with these additives, although the effectiveness of the SOx additives may be reduced somewhat by the somewhat more reducing atmosphere in much of the high efficiency regenerator which is a by-product of our invention.

FCC REACTOR CONDITIONS

In general terms, conventional riser cracking conditions may be used. Typical riser cracking reaction conditions include catalyst/oil ratios of 0.5:1 to 15:1 and preferably 3:1 to 8:1, and a catalyst contact time of 0.1–50 seconds, and preferably 0.5 to 5 seconds, and most preferably about 0.75 to 4 seconds, and riser top temperatures of 900° to about 1050° F.

It is important to have good mixing of each feed stream with catalyst in the base or lower portion of the riser reactor, using conventional techniques such as adding large amounts of atomizing steam, use of multiple nozzles, use of atomizing nozzles and similar technology.

The high nitrogen feed should be added to the riser first, followed by the separate and segregated addition of the low nitrogen feed.

The high nitrogen feed preferably comprises 30–95% of the total fresh feed to the riser, while the low nitrogen feed comprises the remainder. The process works especially well when the high nitrogen feed comprises 50 to 90% of the fresh feed, and the low nitrogen feed comprises the remaining 10 to 50%. Operation with 75 to 85% of the total feed being high nitrogen feed added to the base of the riser, and 15 to 25% of the total feed being low nitrogen feed added higher up in the riser gives especially good results.

The separation between the two feed streams in the riser does not have to be very large. The two feed point locations should be vertically separated by a distance of at least 0.5 times the diameter of the riser at the point of injection of the first feed, and preferably the vertical separation is a least 1 or 2 riser diameters. Very good results are obtained when the two feed points are separated by a distance equal to 5–30% of the riser total height or total hydrocarbon residence time, riser operation with segregation equal to 10–25% being preferred.

It is preferred, but not essential, to have a riser catalyst acceleration zone in the base of the riser.

It is preferred, but not essential, to have the riser reactor discharge into a closed cyclone system for rapid and efficient separation of cracked products from spent catalyst. A preferred closed cyclone system is disclosed in U.S. Pat. No. 4,502,947 to Haddad et al, which is incorporated by reference.

It is preferred but not essential, to rapidly strip the catalyst just as it exits the riser, and upstream of the conventional catalyst stripper. Stripper cyclones disclosed in U.S. Pat. No. 4,173,527, Schatz and Heffley, which is incorporated herein by reference, may be used.

It is preferred, but not essential, to use a hot catalyst stripper. Hot strippers heat spent catalyst by adding some hot, regenerated catalyst to spent catalyst. Suitable hot stripper designs are shown in U.S. Pat. No. 3,821,103, Owen et al, which is incorporated herein by reference. If hot stripping is used, a catalyst cooler may be used to cool the heated catalyst before it is sent to the catalyst regenerator. A preferred hot stripper and catalyst cooler is shown in U.S. Pat. No. 4,820,404, Owen, which is incorporated by reference.

With the exception of the segregated addition of two feeds, the FCC reactor and stripper conditions, per se, can be conventional.

CATALYST REGENERATION

The process of the present invention reduces the $NO_x$ emissions of conventional catalyst regenerators. Preferably a high efficiency FCC regenerator is used. The essential elements of a high efficiency regenerator include a coke combustor, a dilute phase transport riser and a second dense bed. Preferably, a riser mixer is used. These regenerators are widely known and used.

A typical high efficiency FCC regenerator is shown in U.S. Pat. No. 3,926,778, which is incorporated herein by reference.

Conventional single dense bed or bubbling bed regenerators can also be used.

The process of the present invention reduces $NO_x$ emissions by reducing the nitrogen content of the coke on spent catalyst, rather than by some change in regenerator operation.

EXPERIMENT

The concept was tested in a commercial FCC unit by splitting the FCC into two portions, a difficult to crack high nitrogen feed and an easier to crack low nitrogen feed having roughly the same boiling range.

The high nitrogen feed was a Nigerian vacuum gas oil. The low nitrogen feed was a Saffania vacuum gas oil (VGO). The feeds had the following analysis:

| | NIGERIAN | SAFFANIA |
|---|---|---|
| API | 20 | 21 |
| Basic Nitrogen | 770 ppm | 246 |
| CCR | 1 wt % | 0.5 wt % |
| Paraffins | 17.4 wt % | 23.3 wt % |
| Naphthenes | 37.8 wt % | 22.6 wt % |
| Aromatics | 26.8 wt % | 36.0 wt % |
| $C_A$ | 18.0 wt % | 18.0 wt % |
| Boiling Range | | |
| D-1160 | °F. | °F. |
| 5% | 709 | 748 |
| 50% | 833 | 850 |
| 90% | 980 | 950 |
| 95% | 1020 | 980 |

Both of these feeds had about the same boiling range. The primary feed, the Nigerian vacuum gas oil, is somewhat heavier, at least in the region of the 90 and 95% boiling points, however the primary difference in the two stocks is believed to be the nitrogen content.

EXPERIMENT 1 (PRIOR ART)

As a base case, the two feeds were mixed together, and the mixture fed to a commercial, riser cracking FCC unit. The feed mixture contained 81 LV % Nigerian VGO and 19 LV % Saffania VGO. The regenerator flue gas contained 1450 Mg/Nm$^3$ $NO_x$.

EXPERIMENT 2 (INVENTION)

The Nigerian VGO was fed to the base of the riser and the low nitrogen Saffania VGO added as a secondary feed higher up in the riser about 15% of the way up the riser (8 m up, with a total riser length of about 50 m).

The total amount of feed, and the total nitrogen content of the feed, was the same in Experiment 2 as in Example 1, but the regenerator flue gas contained significantly less nitrogen oxides, 1200 Mg/Nm$^3$ $NO_x$.

The regenerator conditions remained essentially unchanged, but are reported below for completeness. The air rate, in MNm$^3$/hr, an indication of coke make, and the temperature remained the same.

The experimental results are summarized below:

| | | | Regenerator | | |
|---|---|---|---|---|---|
| Example | m$^3$/hr | Feed ppm N | $NO_x$ Mg/Nm$^3$ | Air MNm$^3$/hr | Temp. |
| 1 (MIXED FEED) | 135 | 673 | 1450 | 74.7 | 693 C. |
| 2 (SPLIT FEED) | | | | | |
| Nigerian VGO | 110 | 770 | 1200 | 74.8 | 689 C. |
| Saffania VGO | 25 | 245 | | | |

This reduction in $NO_x$ is mainly achieved due to a reduction in nitrogen content of the coke on spent catalyst. The nitrogen content of the spent catalyst in each example is summarized below:

Example 1 220 ppm nitrogen

Example 2 190 ppm nitrogen

There were also some beneficial yield shifts which occurred due to splitting the feed into high and low nitrogen fractions.

This can be seen by examining the following yield patterns.

| | Mixed Feed (Ex 1) | Split Feed (Ex 2) |
|---|---|---|
| Feed rate, $m^3$/hr | 135 | 110 + 25 |
| Riser Top Temp | 523° C. | 523° C. |
| Yields, wt % | | |
| Conversion | 70.0 | 73.0 |
| 1 Slurry | 17.4 | 14.0 |
| G + D | 65.1 | 66.9 |
| $C_4$ and lighter | 12.4 | 13.8 |

Feed segregation, in Example 2, increased conversion significantly, and greatly reduced the yield of slurry oil, which is a very low value product. The $C_4$ and lighter product was highly olefinic, which is an added benefit.

The improvements in the FCC process obtained by simply segregating the feed according to nitrogen content, but not by boiling range, and feeding it at slightly different elevations in the riser reactor are startling.

It is hard to explain why the prior art practice of mixing these two feeds together (Example 1) would produce so much more $NO_x$ and slurry oil than the process of the present invention.

Mixing two feeds of similar boiling range but different nitrogen contents, as was done in Example 1, increased production of slurry oil by 24%, i.e. from 14.0 wt % to 17.4 wt %.

Mixing two feeds of similar boiling range but different nitrogen contents, as was done in Example 1, increased nitrogen oxide emissions by 20%, i.e. from 1200 $Mg/Nm^3$ $NO_x$ to 1450 $Mg/Nm^3$ $NO_x$.

These are spectacular improvements for merely keeping high and low nitrogen feeds segregated. Usually no capital investment is required to practice the invention, most riser reactors have nozzles, or openings through which feed nozzles can easily be added, at multiple elevations in the riser. There are no costs for feed preparation, because the different kinds of feed are simply subjected to their normal distillation steps. The only cost is for separate storage of the feed, and perhaps some minor expense for valves and piping to add the low nitrogen feed higher up in the riser.

The process of the present invention will be especially useful in reducing $NO_x$ emissions resulting from FCC processing of heavy crudes which have not been hydrotreated, or where the quench stream only has been hydrotreated. In this way expensive hydrotreating of feed to reduce total nitrogen content can be avoided, or minimized, or restricted to hydrotreating of only the secondary feed. In many refineries, the process of the present invention will make it possible to reduce $NO_x$ emissions with no hydrotreating of primary or secondary feed.

I claim:

1. In a fluidized catalytic cracking process wherein a fresh feed mixture of high and low nitrogen containing hydrocarbon feeds contact a source of hot regenerated catalyst in the base of a riser cracking reactor means to produce catalytically cracked products and spent catalyst containing coke contaminated with nitrogen compounds, wherein the spent catalyst is stripped in a catalyst stripping means to produce stripped catalyst which is regenerated in a catalyst regeneration means to produce a regenerated catalyst which is recycled to the cracking reactor means, and wherein a flue gas comprising nitrogen oxides ($NO_x$) is withdrawn from the regenerator, the improvement comprising segregating the fresh feed mixture into at least two different fresh feed fractions having different nitrogen contents, said segregated feed fractions comprising a low nitrogen content fresh feed and a high nitrogen content fresh feed having at least a 50% greater concentration of nitrogen than the low nitrogen content fresh feed, adding said high nitrogen content fresh feed via a feed addition means at an elevation in the base of the riser reactor, and separately adding said low nitrogen content fresh feed to the riser reactor at a higher elevation in said riser reactor and downstream of the point of addition of said high nitrogen content fresh feed, whereby the $NO_x$ content of the flue gas is reduced relative to operation with a feed comprising a mixture of said high and said low nitrogen containing feedstocks.

2. The improved process of claim 1 wherein the high nitrogen content feed has a basic nitrogen content of at least 500 ppm N, and the low nitrogen content fresh feed has a basic nitrogen content below 500 ppm N.

3. The improved process of claim 1 wherein the high nitrogen content feed has a basic nitrogen content at least double that of the low nitrogen content fresh feed.

4. The improved process of claim 1 wherein the high and low nitrogen content feeds have a boiling range, and wherein the 90 wt % boiling points of both streams differ by no more than 50° C.

5. The improved process of claim 1 wherein the riser reactor means has a total length and wherein the low nitrogen content feed is added at an elevation equal to 5 to 25% of the total length of the riser.

6. The improved process of claim 1 wherein the low nitrogen content feed is present in an amount equal to 10 to 50 wt % of the high nitrogen content fresh feed.

7. The improved process of claim 1 wherein the low nitrogen content feed is present in an amount equal to 20 to 35 wt % of the high nitrogen content fresh feed.

8. The improved process of claim 1 wherein both feeds boil within the range of gas oils and vacuum gas oils.

9. The improved process of claim 1 wherein both feeds are vacuum gas oils.

10. In a fluidized catalytic cracking process wherein a fresh feed mixture of high nitrogen fresh feed containing more than 500 ppm basic nitrogen and a low nitrogen content fresh feed containing less than 500 ppm basic nitrogen and mixed and charged to the base of a riser cracking reactor means to contact a source of hot regenerated catalyst and produce catalytically cracked products and spent catalyst containing coke contaminated with nitrogen compounds, wherein the spent catalyst is stripped in a catalyst stripping means to produce stripped catalyst which is regenerated in a catalyst regeneration means to produce a regenerated catalyst which is recycled to the cracking reactor means, and wherein a flue gas comprising nitrogen oxides ($NO_x$) is withdrawn from the regenerator, the improvement comprising segregating the fresh feed mixture into at least two segregated fresh feed fractions, having boiling ranges which overlap through at least 50% of the boiling range of each feed, and different nitrogen contents, said segregated feed fractions comprising a low nitrogen content fresh feed containing less than 400 ppm basic nitrogen and a high nitrogen content fresh feed having at least 600 ppm basic nitrogen, and adding said high nitrogen content fresh feed via a feed addition means at an elevation in the base of the riser reactor, and separately adding said low nitrogen content fresh feed, in an amount equal to 10 to 50 wt % of said high nitrogen content fresh feed, to said riser reactor at a higher elevation in said riser reactor and downstream of the point of addition of said high nitrogen content fresh feed, whereby the $NO_x$ content of the flue gas is reduced relative to operation with a feed comprising a mixture of said high and said low nitrogen containing feedstocks.

11. The improved process of claim 10 wherein the high nitrogen content feed has a basic nitrogen content at least double that of the low nitrogen content fresh feed.

12. The improved process of claim 10 wherein the high and low nitrogen content feeds have a boiling range, and wherein the 90 wt % boiling points of both streams differ by no more than 50° C.

13. The improved process of claim 10 wherein the riser reactor means has a total length and wherein the low nitrogen content feed is added at an elevation equal to 5 to 25% of the total length of the riser.

14. The improved process of claim 10 wherein the low nitrogen content feed is present in an amount equal to 20 to 35 wt % of the high nitrogen content fresh feed.

15. The improved process of claim 10 wherein both feeds are vacuum gas oils.

* * * * *